US012291924B2

(12) United States Patent
Dimitroff

(10) Patent No.: US 12,291,924 B2
(45) Date of Patent: May 6, 2025

(54) EXCAVATION BORING AND SHORING TOOL

(71) Applicant: Ted R. Dimitroff, Columbia, MO (US)

(72) Inventor: Ted R. Dimitroff, Columbia, MO (US)

( * ) Notice: Subject to any disclaimer, the term of this patent is extended or adjusted under 35 U.S.C. 154(b) by 0 days.

(21) Appl. No.: 18/603,759

(22) Filed: Mar. 13, 2024

(65) Prior Publication Data

US 2024/0218741 A1 Jul. 4, 2024

Related U.S. Application Data

(62) Division of application No. 17/932,797, filed on Sep. 16, 2022, now Pat. No. 11,988,044.

(51) Int. Cl.

| | |
|---|---|
| ***E21B 10/26*** | (2006.01) |
| ***E21B 33/14*** | (2006.01) |
| ***E21D 5/01*** | (2006.01) |

(52) U.S. Cl.

CPC ..... *E21B 10/26* (2013.01); *E21B 33/14* (2013.01); *E21D 5/01* (2013.01)

(58) Field of Classification Search

CPC ..... E21D 5/01; E21D 33/14; E21D 10/26
See application file for complete search history.

(56) References Cited

U.S. PATENT DOCUMENTS

| | | | | |
|---|---|---|---|---|
| 5,017,016 | A | 5/1991 | Nasu | |
| 5,167,719 | A | 12/1992 | Tamaki | |
| 5,176,212 | A | 1/1993 | Tandberg | |
| 5,823,276 | A * | 10/1998 | Beck, III | E02D 5/36 175/405.1 |
| 8,926,229 | B1 | 1/2015 | Clair | |
| 9,255,476 | B2 | 2/2016 | Mancini et al. | |
| 2006/0196699 | A1 | 9/2006 | Estes et al. | |
| 2010/0209199 | A1 | 8/2010 | Pogue | |
| 2011/0299941 | A1 | 12/2011 | Dimitroff | |

(Continued)

FOREIGN PATENT DOCUMENTS

| | | | |
|---|---|---|---|
| CN | 114753770 | A * | 7/2022 |
| DE | 3735008 | A1 | 5/1989 |

(Continued)

OTHER PUBLICATIONS

Dong et al., Chinese Patent No. 114753770A, dated Jul. 15, 2022, english translation dated Sep. 26, 2024. (Year: 2022).*

(Continued)

*Primary Examiner* — Caroline N Butcher
(74) *Attorney, Agent, or Firm* — Mckee, Voorhees & Sease, PLC

(57) ABSTRACT

A reaming tool forms a hole in the ground with a sidewall and a floor, and a deepened channel around the perimeter of the floor adjacent to sidewall. Fluid is provided during excavation to form a slurry to hold the sidewall and prevent cave-in of material into the hole. After the hole reaches a desired depth, the reaming tool is removed, and a shoring wall is inserted into the hole through the slurry and seated in the perimeter edge channel. The shoring wall includes vertical tubes for connection to a dewatering machine. Then, the slurry can be vacuumed from the hole, while the dewatering machine keeps the empty hole as dry as possible. Extending the shoring wall into the channel beyond the floor of the hole helps seal flow of water from entering the hole.

20 Claims, 5 Drawing Sheets

(56) References Cited

U.S. PATENT DOCUMENTS

| | | | |
|---|---|---|---|
| 2012/0219363 | A1 | 8/2012 | Dimitroff |
| 2013/0228382 | A1 | 9/2013 | Sauvageau |

FOREIGN PATENT DOCUMENTS

| | | | |
|---|---|---|---|
| DE | 9115823 | U1 | 2/1992 |
| DE | 9207366 | U1 | 8/1992 |
| DE | 4142222 | A1 | 6/1993 |
| DE | 4109691 | C2 | 1/1994 |
| EP | 377087 | A2 | 7/1990 |
| EP | 351440 | B1 | 12/1992 |
| JP | 2705803 | B2 | 1/1998 |
| JP | 4147237 | B2 | 9/2008 |

OTHER PUBLICATIONS

Das, Madhurima, "Cylinder: Shape, Definition, Types, Forumlas, Properties—Embibe" Oct. 26, 2023, www.embibe.com/exams/cylinder. (Year: 2023) 2023.

Welker et al., "Evaluation of a Commercial Vacuum System for the Removal of Asbestos," EPA Research and Development, EPA-600/2-80-088, 85 pages, May 1980.

* cited by examiner

EXCAVATION BORING AND SHORING TOOL

CROSS-REFERENCE TO RELATED APPLICATIONS

This application is a Divisional application of nonprovisional application U.S. Ser. No. 17/932,797, filed on Sep. 16, 2022, which is herein incorporated by reference in its entirety.

TECHNICAL FIELD

The invention relates to equipment and methodology for creating and maintaining an excavated hole in the ground.

BACKGROUND

The excavation of material to form a hole or pit in the ground, such as to provide an in-the-ground work area, can be done in many ways. Depending on soil conditions, the excavated hole may require shoring to prevent material from caving into the open hole and to maintain the sidewall of the hole. For example, if the soil is dry and loose, or very wet, the hole sidewall will not stand on its own, such that shoring is required to hold the sidewall in place. Some existing methods require the ground or soil to be dewatered prior to excavation. In other instances, the shoring structure must be installed as the soil is excavated, until the hole or pit reaches a desired depth. These current methods have problems with the soil, sand or water falling into the excavated area. Another alternative method, though expensive, is to drive sheet piling steel into the ground before excavation, and then excavating the soil or sand.

Accordingly, a primary objective of the present invention is the provision of a method for improved excavation and shoring of a hole or pit in the ground.

Another objective of the present invention is the provision of equipment to simplify the excavation and shoring of a hole in the ground.

A further objective of the present invention is the provision of an excavation reaming tool to form a pit in the ground having a deeper perimeter edge than the floor of the pit.

Still another objective of the present invention is the provision of a shoring structure having tubes for connection to a dewatering machine.

Another objective of the present invention is the provision of a method of excavating a hole with a reaming tool and the use of slurry to maintain the sidewall of the excavated hole, prior to installation of a shoring ring.

These and other objectives will become apparent from the following description of the invention.

SUMMARY

The method of the present invention for excavating and shoring a hole in the ground utilizes an innovative reaming tool and shoring ring to simplify the process and avoid problems of prior art processes for excavation and shoring.

The method includes drilling a hole in the ground having a sidewall, a floor at a first depth, and the perimeter edge around the hole at a second depth deeper than the floor. Water is provided during excavation so as to create a slurry to help hold back the sidewall as the hole is formed. Then, a shoring ring is installed in the excavated hole so as to sit downwardly into the deepened perimeter edge. The slurry can then be vacuumed out of the hole. The shoring ring includes internal vertical tubes, which can be connected to a conventional dewatering machine so to further suck moisture out of the excavated hole and from the surrounding soil.

The reaming tool for excavating the hole is generally circular in shape and is driven by a driveshaft which rotates and forces the tool downwardly as cutting tips on the reamer head bore through the soil material. The perimeter edge of the reaming head includes legs with cutting tips to form the deepened perimeter edge of the hole. The shoring ring includes inner and outer walls, with a plurality of vertical tubes residing between the inner and outer walls. The upper ends of the tubes are adapted to be connected to hoses of a dewatering machine.

DETAILED DESCRIPTION

Figure 2:
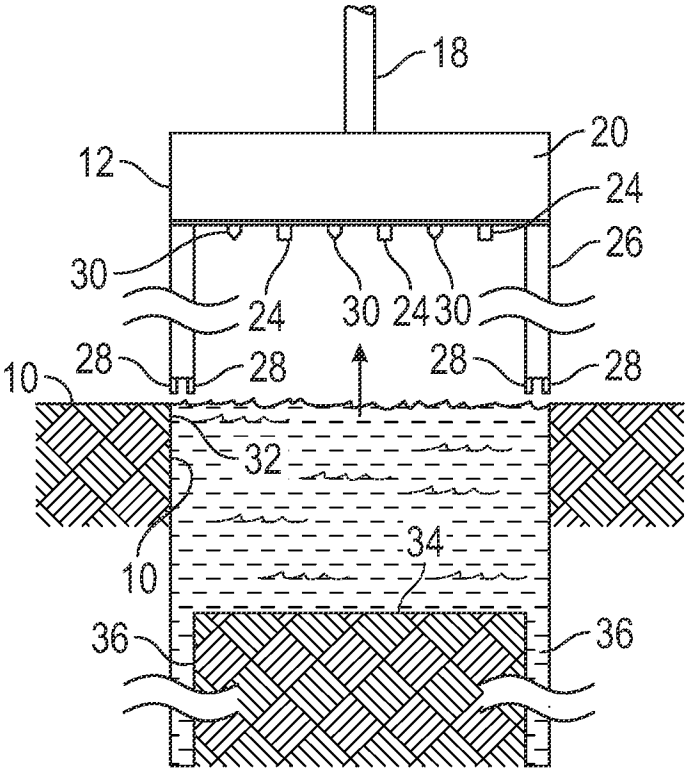
FIG. 2 is a schematic view showing the reamer tool removed from the ground after the hole is formed.
Figure 1:
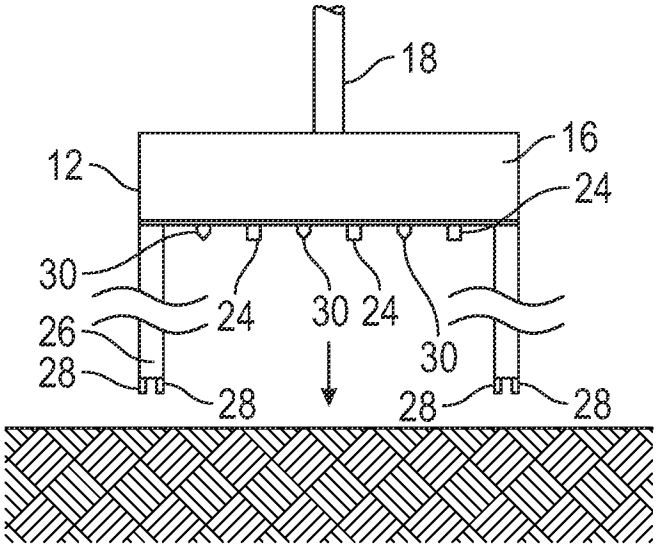
FIG. 1 is a schematic view showing the reamer tool positioned above the ground in preparation for excavation.

The method of the present invention for forming a hole or pit 10 in the ground is illustrated in FIGS. 1-4. The equipment used to form and maintain the hole 10 is shown in FIGS. 5-8. The equipment includes a reaming tool 12 and a shoring tool 14.

The reaming tool 12 includes a drill head 16 connected to a shaft 18. The head 16 includes an outer perimeter ring 20 with cross bars or braces 22 extending across the ring 20. A plurality of cutting tips 24 made of carbide or other hard material is provided on the bottom surface of the head 16, such as on the cross bars 22. A plurality of legs 26 extend downwardly from the perimeter of the ring 20 and have cutting tips 28 on the bottom of the legs. Alternatively, the perimeter 20 of the reamer head can extend below the cross bars 22, without the legs 26, such that the cutting tips 28 reside below the cutting tips 24.

The shaft 18 is adapted to be connected to a machine to rotate and drive the head 16 downwardly into the soil so that the cutters 24, 28 grind the soil. Fluid nozzles or ports 30 are provided on the head 16 to deliver water or other cutting fluid to the soil as the head 16 is rotated, so as to create a slurry with the ground soil. The nozzles 30 can be mounted on the head 16 at any convenient location, such as on the braces 22, and connected to an above-ground fluid source. The nozzles 30 are connected by one or more hoses extending through or along the shaft 18 to a fluid source above the ground. As the head 16 is forced downwardly, and the soil is ground by the cutters 24, 28, the slurry helps maintain the sidewall 32 of the hole 10. The cutters 24 form a floor 35 of the hole 10 at a desired depth. The cutters 28 form a deepened channel or perimeter edge 36 around the floor 34 adjacent to sidewall 32 of the hole 10. After the hole 10 reaches the desired depth, the reaming tool 12 is removed, so that the shoring tool 14 can be inserted into the hole 10.

In the preferred embodiment, the shoring tool 14 includes an inner wall 38 and an outer wall 40, which preferably are arranged concentric to another so as to form a gap 42 between the walls 38, 40. A plurality of tubes 44 extend within the gap or space 42 between the upper and lower ends of the walls 38, 40. Preferably, the tubes 44 extend vertically. The tubes 44 are open at their upper and lower ends. The upper ends of the tubes 44 are adapted to be connected to hoses of a dewatering machine, using any convenient coupling means, such as threads, or quick coupler attachment. The dewatering machine is conventional.

In an alternative embodiment, the shoring ring can have a single wall to engage the sidewall of the hole, with the vertical tubes attached or mounted on the inside surface of the single wall.

Figure 4:
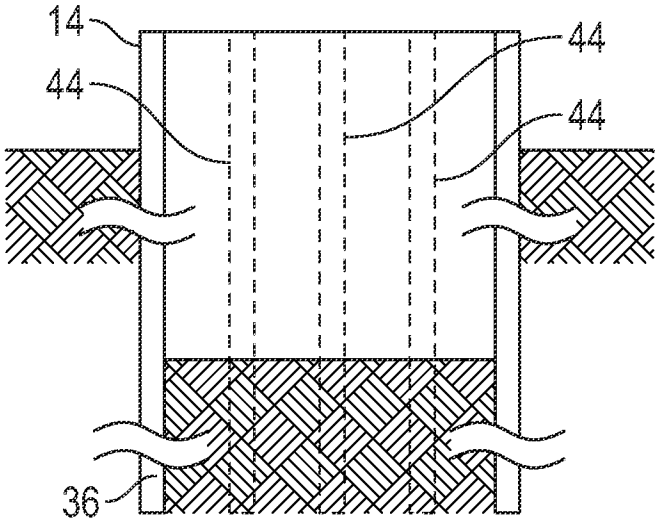
FIG. 4 is a schematic view showing the shoring ring installed in the excavated hole.
Figure 3:
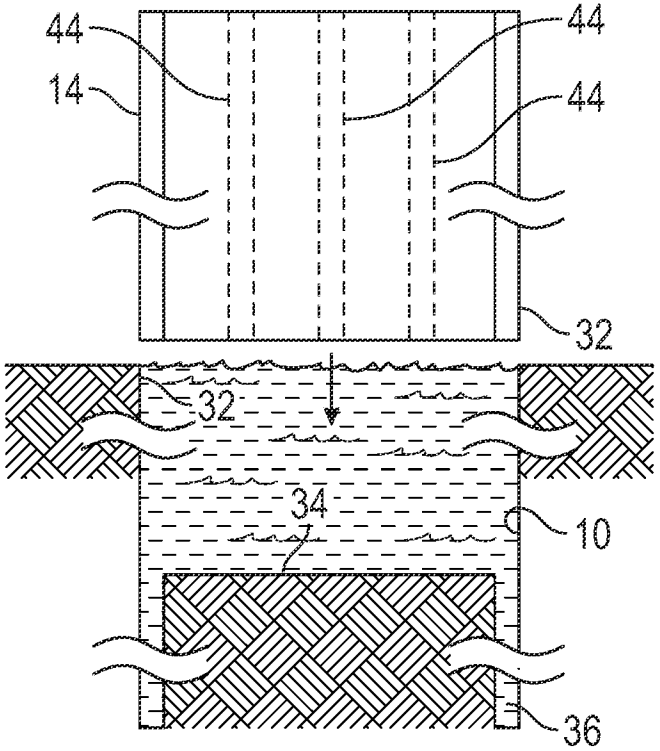
FIG. 3 is a schematic view showing the shoring ring positioned above the hole, prior to installation of the ring.
Figure 5:
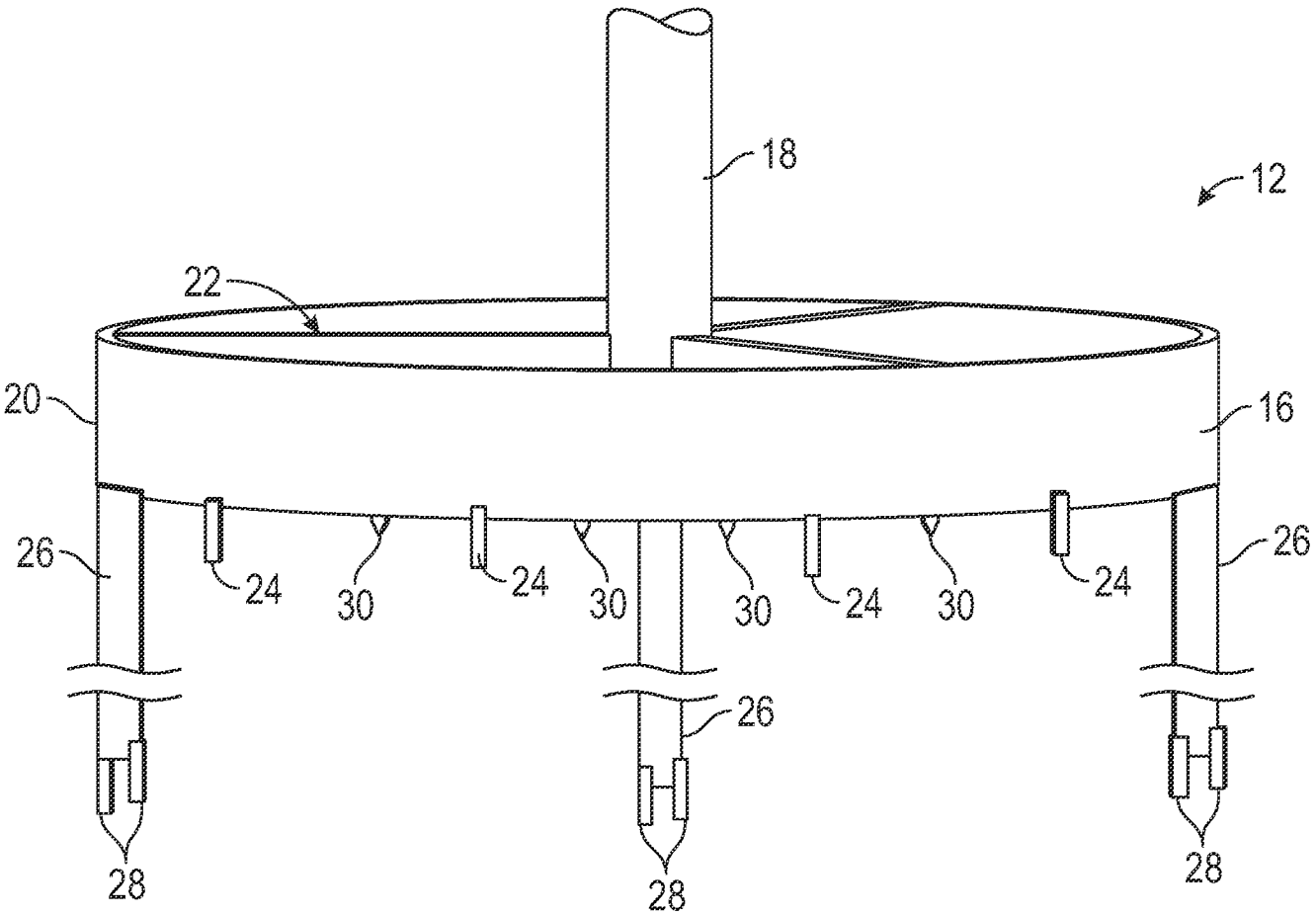
FIG. 5 is a perspective view of the reamer tool of the present invention.
Figure 6:
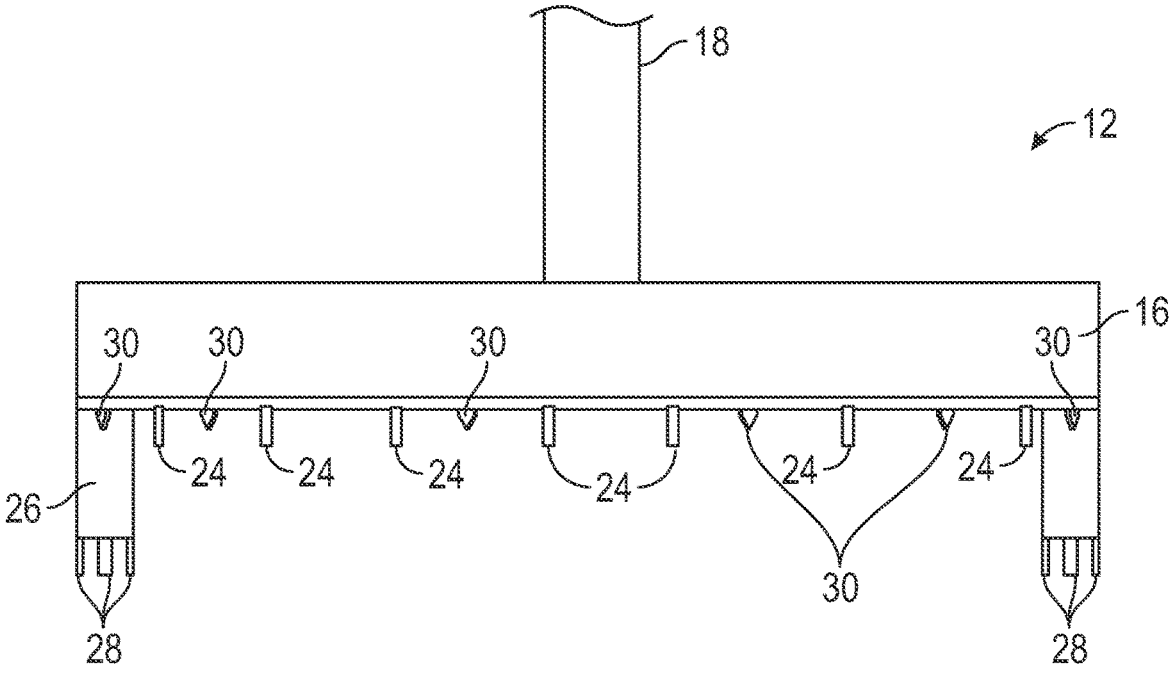
FIG. 6 is a side elevation view of the reamer tool.
Figure 8:
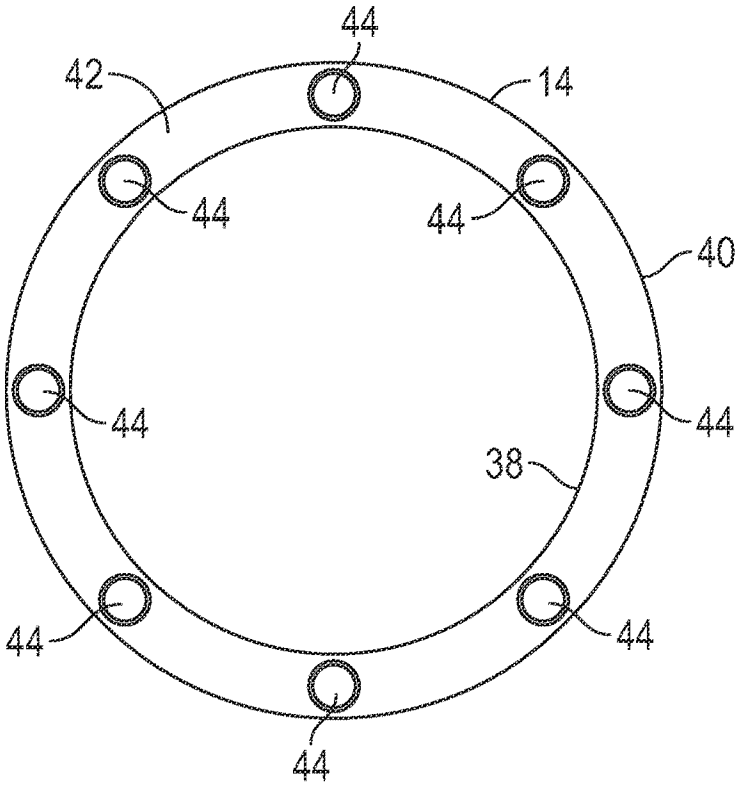
FIG. 8 is a top plane view of the shoring ring shown in FIG. 7.
Figure 7:
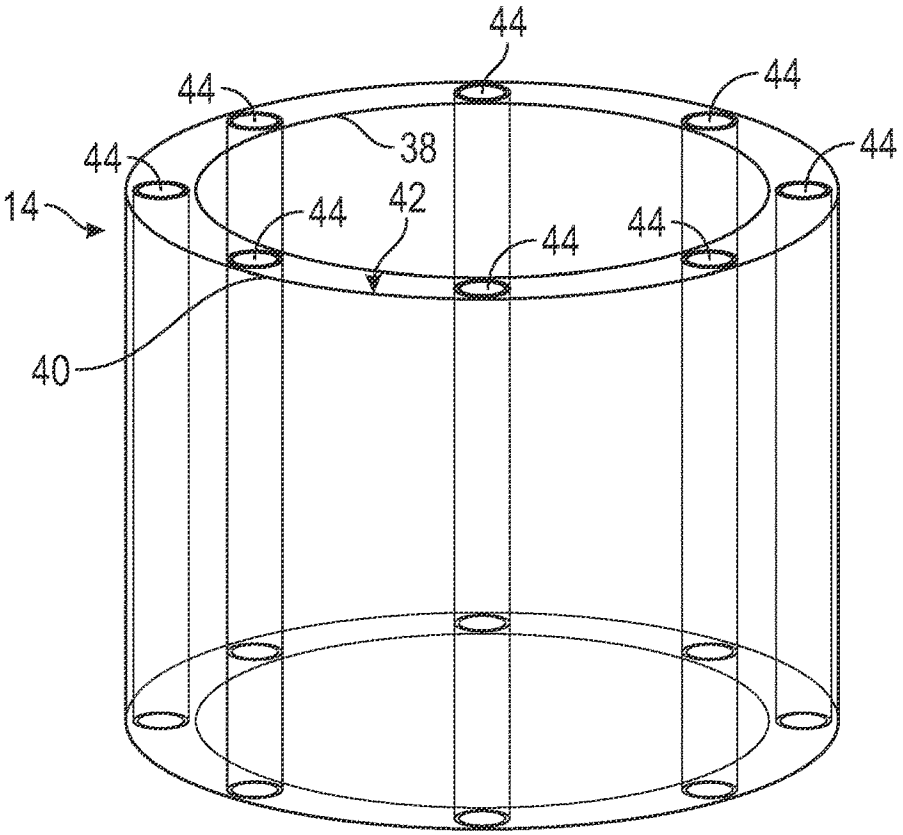
FIG. 7 is a perspective view of the shoring ring of the present invention.

After the hole 10 is formed and the reaming tool 12 is removed, the shoring tool or ring 14 can be forced downwardly through the slurry in the hole 10 until the bottom edge of the walls 38, 40 is seated in the bottom of the channel 36. The upper end of the walls 38, 40 may extend above the surrounding surface of the ground, as seen in FIG. 4. Thus, the shoring tool 14 will retain the sidewall 32 of the hole 10 and prevent cave-in of soil into the hole. After the shoring tool 14 is installed, the slurry material can be vacuumed or removed by other means from the hole, and the dewatering machine can be connected to the tubes 44 to remove additional water seeping from the soil into the hole 10.

Thus, the hole can be formed and maintained in a relatively dry condition so that workers and equipment can be lowered into the hole for whatever work is being performed. By extending the shoring ring 14 beyond the floor 34 of the hole 10, the shoring ring helps seal the flow of water onto the floor 34.

The "invention" is not intended to refer to any single embodiment of the particular invention but encompass all possible embodiments as described in the specification and the claims. The "scope" of the present disclosure is defined by the appended claims, along with the full scope of equivalents to which such claims are entitled. The scope of the disclosure is further qualified as including any possible modification to any of the aspects and/or embodiments disclosed herein which would result in other embodiments, combinations, subcombinations, or the like that would be obvious to those skilled in the art.

What is claimed is:

1. A reaming tool for excavating a hole in the ground, comprising:

a circular drill head having a first set of cutting tips adapted to break up the ground as the drill head rotates and thereby form a floor in the hole;

the circular drill head having a second set of cutting tips extending around a perimeter edge of the drill head and extending downwardly further than the first set of cutting tips to form a deepened perimeter channel of the hole;

the first and second cutting tips being operatively connected to one another so as to rotate in unison; and a shaft connected to the drill head and extending upwardly for connection to a power source to rotatably drive the drill head to rotate the first and second cutting tips so as to simultaneously form the hole and the perimeter channel around the floor.

2. The reaming tool of claim 1 wherein the first set of cutting tips all have terminal ends residing in a first plane.

3. The reaming tool of claim 1 wherein the second set of cutting tips all have terminal ends residing in a second plane, the second plane extending beyond the first plane.

4. The reaming tool of claim 1 wherein the shaft is hollow so as to be adapted to connect to a fluid source to provide fluid to the first set of cutting tips as the drill head is rotated.

5. The reaming tool of claim 1 wherein the drill head has upper and lower ends, and the first and second sets of cutting tips are on the lower end of the drill head.

6. The reaming tool of claim 1 wherein the drill head is a ring.

7. The reaming tool of claim 6 wherein the cutting head includes cross bars extending across the ring.

8. The reaming tool of claim 7 wherein the ring extends downwardly beyond the cross bars.

9. The reaming tool of claim 7 wherein the first set of cutting tips are on the cross bars.

10. The reaming tool of claim 6 wherein the second set of cutting tips are on the ring.

11. The reaming tool of claim 1 further comprising nozzles on the drill head and adapted to be connected to hoses to supply fluid during rotation of the drill head.

12. The reaming tool of claim 1 wherein the drill head has out outer perimeter and a substantially open interior within the perimeter.

13. A reaming tool for drilling a hole in soil, comprising;

a ring with cross bars rigidly connected to the ring;

a first set of cutting tips on the cross bars;

a second set of cutting tips on the ring;

the second set of cutting tips extending downwardly beyond the first set of cutting tips;

a drive shaft extending centrally upwardly from the cross bars to rotate the first and second sets of cutting tips in unison; and the rings being free of obstructions between the cross bars.

14. The reaming tool of claim 13 wherein the ring has an open top side and an open bottom side.

15. The reaming tool of claim 13 has top and bottom ends and is substantially open between the top and bottom ends whereby soil drilled by the cutting tips passes upwardly through the ring.

16. The reaming tool of claim 13 further comprising fluid nozzles adjacent at least some of the first and second cutting tips and adapted to be connected to a fluid source to spray fluid from the nozzles during drilling of the soil.

17. The reaming tool of claim 13 wherein the cross bars have lower ends and the ring has lower ends, with the ring lower ends extending to an elevation below the lower ends of the cross bars.

18. The reaming tool of claim 13 wherein the ring is circular.

19. A reaming tool for forming a hole in the ground, comprising:

a drilling head having an outer circular ring and interior cross bars fixed to the ring;

a first set of cutters on the cross bars for forming a floor of the hole;

a second set of cutters on the ring;

the second sets of cutters extending deeper into the ground than the first set of cutters so as to form a deepened perimeter channel around the floor;

a drive shaft connected to the drilling head to rotate the drilling head and to force the drilling head downwardly whereby the first set of cutters drill the hole in the ground while the second set of cutters form the perimeter channel; and fluid nozzles on the drilling head to supply fluid to the first and second cutters during drilling.

20. The reaming tool of claim 19 wherein the drilling head is substantially hollow within the ring.

* * * * *